US012152311B2

(12) United States Patent
Chang et al.

(10) Patent No.: US 12,152,311 B2
(45) Date of Patent: Nov. 26, 2024

(54) WETTING METHOD FOR SUBSTRATE AND PLATING APPARATUS

(71) Applicant: EBARA CORPORATION, Tokyo (JP)

(72) Inventors: Shao Hua Chang, Tokyo (JP); Masaya Seki, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 301 days.

(21) Appl. No.: 17/761,304

(22) PCT Filed: Dec. 28, 2020

(86) PCT No.: PCT/JP2020/049158

§ 371 (c)(1),
(2) Date: Mar. 17, 2022

(87) PCT Pub. No.: WO2022/144988

PCT Pub. Date: Jul. 7, 2022

(65) Prior Publication Data

US 2023/0167572 A1 Jun. 1, 2023

(51) Int. Cl.
*C25D 17/06* (2006.01)
*C25D 5/02* (2006.01)
(Continued)

(52) U.S. Cl.
CPC ..... *C25D 17/06* (2013.01); *C25D 5/02* (2013.01); *C25D 17/004* (2013.01); *C25D 17/02* (2013.01); *C25D 21/14* (2013.01)

(58) Field of Classification Search
None
See application file for complete search history.

(56) References Cited

U.S. PATENT DOCUMENTS 6,558,518 B1 * 5/2003 Sendai ..... C25D 7/123 204/224 R
6,926,817 B2 * 8/2005 Marumo ..... H01L 21/67057 204/224 R (Continued)

FOREIGN PATENT DOCUMENTS

EP 1118696 A1 7/2001
JP 2001-049495 A 2/2001

(Continued)

*Primary Examiner* — Stefanie S Wittenberg
(74) *Attorney, Agent, or Firm* — BakerHostetler

(57) ABSTRACT

Provided is a wetting method for substrate that allows reducing an amount of air bubbles attached to a surface to be plated with a simple structure.
The wetting method for substrate includes a holding step 102 of holding a back surface of a substrate with a back plate such that a surface to be plated of the substrate is opposed to a liquid surface of a plating solution housed in a plating tank, a supplying step 104 of supplying the plating solution to the plating tank such that the plating solution upwardly flows through a plurality of through-holes in a center part of an ionically resistive element arranged inside the plating tank to raise a center part of the liquid surface of the plating solution, a first lowering step 106 of lowering a supporting member for supporting an outer edge portion of the surface to be plated of the substrate held by the holding member toward the liquid surface of the plating solution, and a second lowering step 108 of lowering the holding member such that the substrate is sandwiched by the supporting member lowered in the first lowering step 106 and the holding member while the center part of the liquid surface of the plating solution is raised in the supplying step 104.

4 Claims, 9 Drawing Sheets

(51) Int. Cl.

| | |
|---|---|
| ***C25D 17/00*** | (2006.01) |
| ***C25D 17/02*** | (2006.01) |
| ***C25D 21/14*** | (2006.01) |

(56) References Cited

U.S. PATENT DOCUMENTS

| | | | | |
|---|---|---|---|---|
| 2004/0182712 | A1* | 9/2004 | Basol | C25D 7/123<br>205/98 |
| 2006/0131177 | A1* | 6/2006 | Bogart | C25D 17/001<br>257/E21.585 |
| 2008/0210562 | A1* | 9/2008 | Kawakami | C25D 17/008<br>204/225 |

FOREIGN PATENT DOCUMENTS

| | | | |
|---|---|---|---|
| JP | 2003-27288 | A | 1/2003 |
| JP | 2003-253488 | A | 9/2003 |
| JP | 2003-313697 | A | 11/2003 |
| JP | 2008-19496 | A | 1/2008 |
| WO | WO00/014306 | A1 | 3/2000 |

* cited by examiner

1000

WETTING METHOD FOR SUBSTRATE AND PLATING APPARATUS

TECHNICAL FIELD

This application relates to a wetting method for substrate and a plating apparatus.

BACKGROUND ART

There has been known a cup type electroplating apparatus as an example of a plating apparatus. The cup type electroplating apparatus immerses a substrate (such as a semiconductor wafer) held by a substrate holder into a plating solution with a surface to be plated facing downward, and causes a conductive film to deposit on a surface of the substrate by applying voltage between the substrate and an anode.

In the cup type electroplating apparatus, air bubbles are likely to be attached to the surface to be plated when immersing the substrate into the plating solution. Air bubbles attached to the surface to be plated could possibly influence a plating performance and thus are not preferred. Therefore, for example, PTL 1 discloses a method to reduce an amount of air bubbles attached to the surface to be plated of the substrate by inclining the surface to be plated with respect to the horizontal plane, and gradually bringing the inclined substrate from a lower end side in contact with the plating solution.

CITATION LIST

Patent Literature

PTL 1: Japanese Unexamined Patent Application Publication No. 2008-19496

SUMMARY OF INVENTION

Technical Problem

However, in order to reduce the amount of air bubbles attached to the surface to be plated, the prior art could possibly complicate the structure of the electroplating apparatus.

That is, since the anode and the surface to be plated of the substrate are preferred to be in parallel when performing the plating process, the prior art requires a mechanism to incline the substrate when bringing the substrate into contact with the plating solution, and to return the inclination of the substrate to its original state after the substrate has been in contact with the plating solution. Such mechanism could possibly complicate the structure of the electroplating apparatus.

Therefore, one object of the present application is to reduce the amount of air bubbles attached to the surface to be plated with a simple structure.

Solution to Problem

One embodiment discloses a liquid contact method of substrate including: a holding step of holding a back surface of a substrate with a holding member such that a surface to be plated of the substrate is opposed to a liquid surface of a plating solution housed in a plating tank; a supplying step of supplying the plating solution to the plating tank such that the plating solution upwardly flows through a plurality of through-holes in a center part of an ionically resistive element arranged inside the plating tank to raise a center part of the liquid surface of the plating solution; a first lowering step of lowering a supporting member for supporting an outer edge portion of the surface to be plated of the substrate held by the holding member toward the liquid surface of the plating solution; and a second lowering step of lowering the holding member such that the substrate is sandwiched by the supporting member lowered in the first lowering step and the holding member while the center part of the liquid surface of the plating solution is raised in the supplying step.

DESCRIPTION OF EMBODIMENTS

Figure 1:
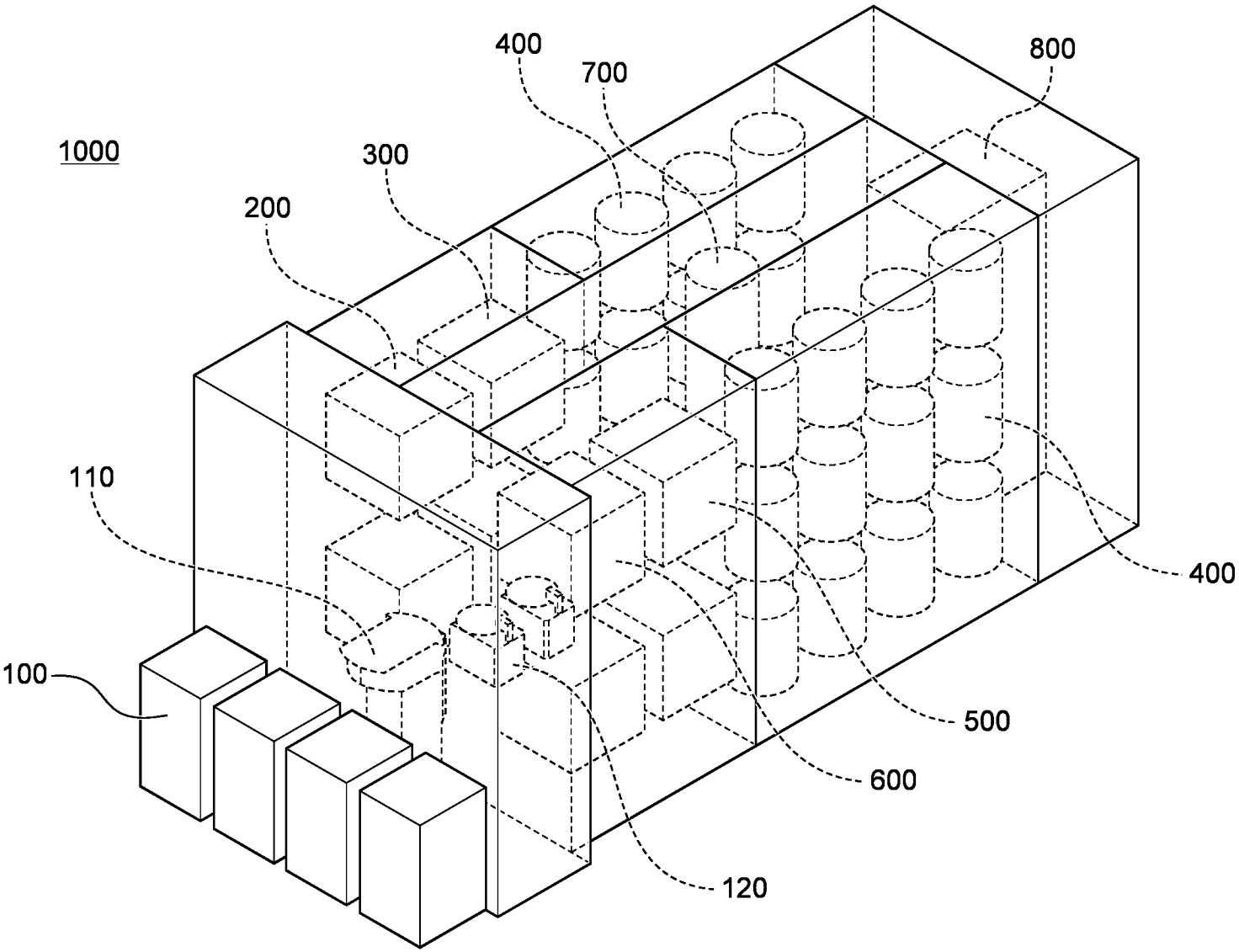
FIG. 1 is a perspective view illustrating an overall configuration of a plating apparatus of this embodiment.

The following describes embodiments of the present invention with reference to the drawings. In the drawings described later, identical reference numerals are assigned to identical or equivalent constituent elements, and overlapping descriptions are omitted.

<Overall Configuration of Plating Apparatus>

Figure 2:
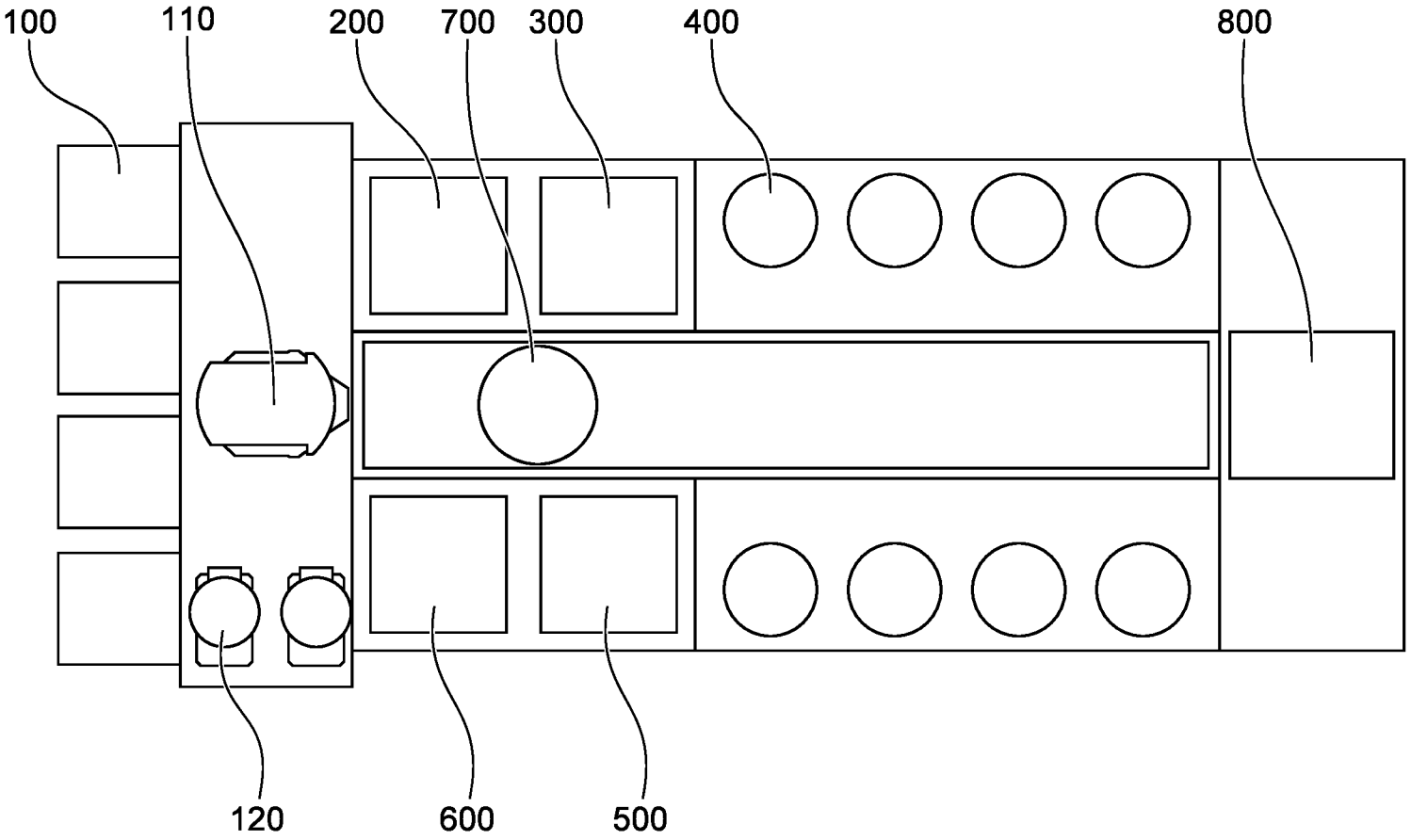
FIG. 2 is a plan view illustrating the overall configuration of the plating apparatus of this embodiment.

FIG. 1 is a perspective view illustrating the overall configuration of the plating apparatus of this embodiment. FIG. 2 is a plan view illustrating the overall configuration of the plating apparatus of this embodiment. As illustrated in FIGS. 1 and 2, a plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the transfer device 700. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers are disposed to be arranged in the vertical direction in this embodiment, the number of spin rinse dryers and arrangement of the spin rinse dryers are arbitrary. The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 700.

The transfer device 700 transfers the substrate received from the transfer robot 110 to the pre-wet module 200. The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer device 700 grips or releases the substrate on which the drying process has been performed to the transfer robot 110. The transfer robot 110 transfers the substrate received from the transfer device 700 to the cassette at the load port 100. Finally, the cassette housing the substrate is unloaded from the load port 100.

<Configuration of Plating Module>

Next, the configuration of the plating module 400 is described. The 24 plating modules 400 in the present embodiment have identical configurations and thus only one of the plating modules 400 is described.

Figure 3:
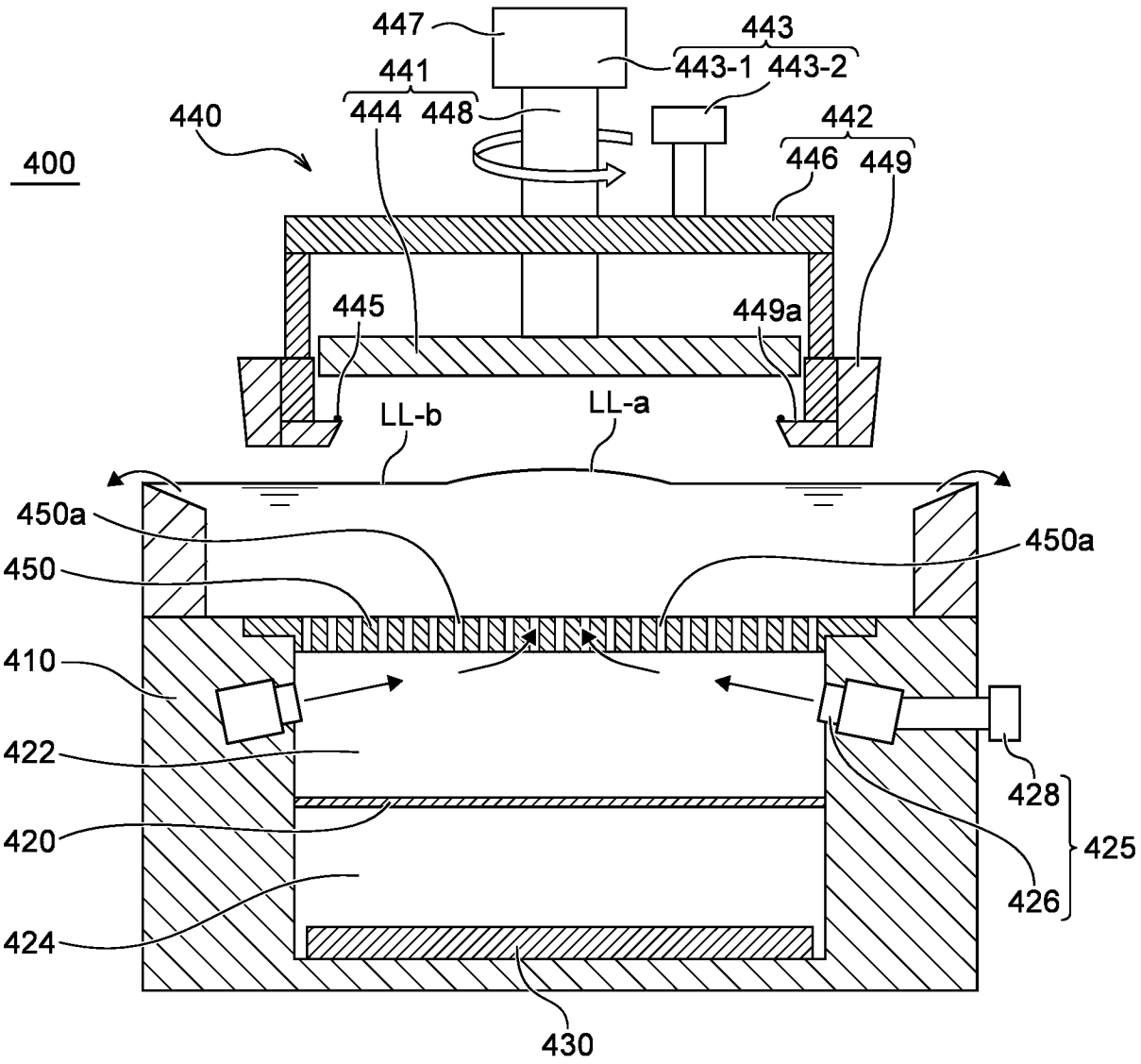
FIG. 3 is a vertical cross-sectional view schematically illustrating a configuration of a plating module of this embodiment in a state where the substrate is not held.
Figure 4:
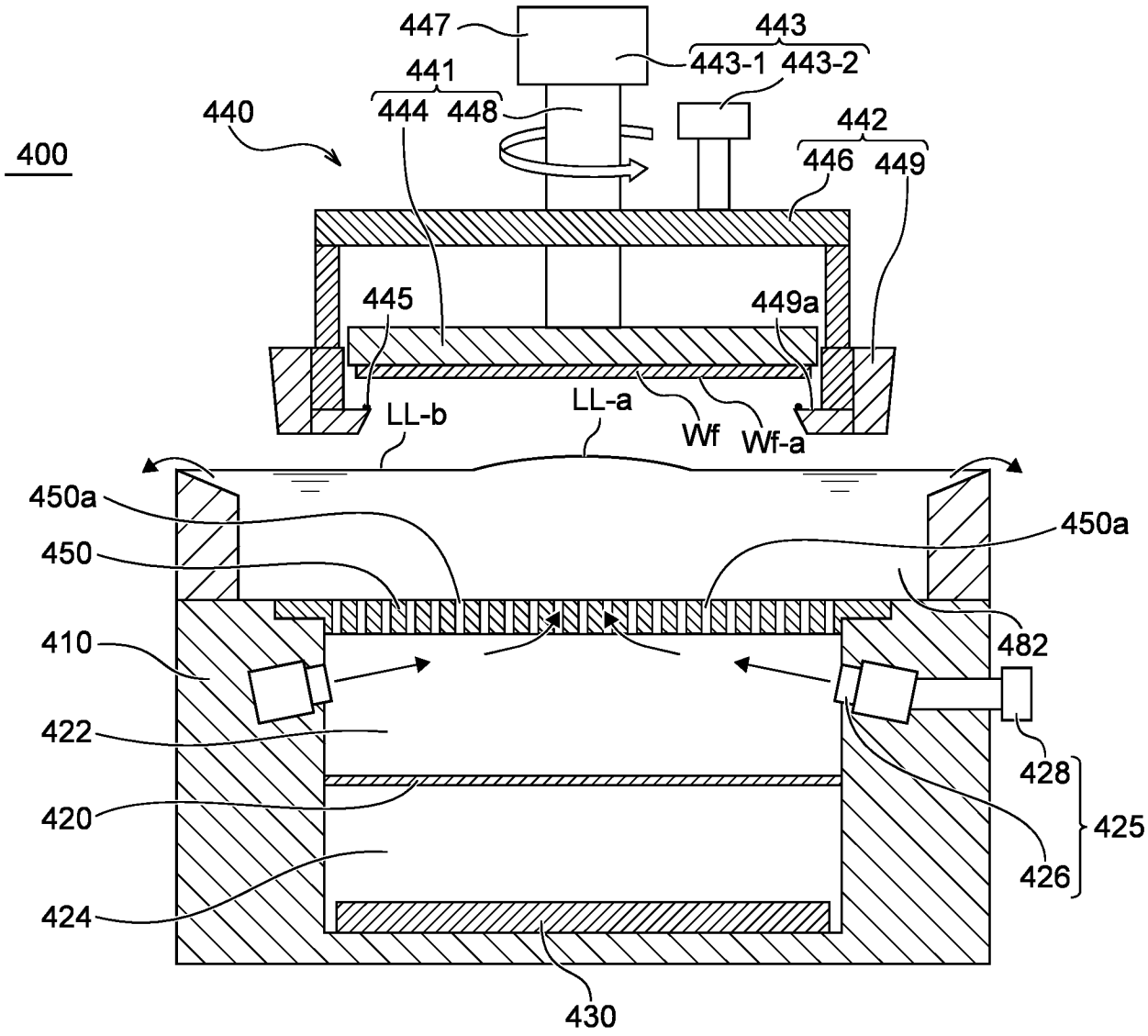
FIG. 4 is a vertical cross-sectional view schematically illustrating the configuration of the plating module of this embodiment in a state where the substrate is held.

FIG. 3 is a vertical cross-sectional view schematically illustrating the configuration of the plating module of this embodiment in a state where the substrate is not held. FIG. 4 is a vertical cross-sectional view schematically illustrating the configuration of the plating module of this embodiment in a state where the substrate is held. As illustrated in FIG. 3 and FIG. 4, the plating module 400 includes a plating tank 410 for housing the plating solution. The plating module 400 also includes a substrate holder 440 for holding a back surface of the substrate Wf in a state where a surface to be plated Wf-a is faced downward so as to be opposed to the liquid surface of the plating solution. The substrate holder 440 includes a power feeding contact point for feeding power from a power source (not illustrated) to a substrate Wf.

The plating module 400 also includes a membrane 420 dividing an inside of the plating tank 410 in a vertical direction. The inside of the plating tank 410 is partitioned by the membrane 420 into a cathode region 422 and an anode region 424. An anode 430 is disposed in a bottom surface of the plating tank 410 in the anode region 424. An ionically resistive element 450 is arranged opposed to the membrane 420 in the cathode region 422. The ionically resistive element 450 is configured as a plate-shaped member in which a plurality of through-holes 450*a* are formed. The plurality of through-holes 450*a* are distributed in a region corresponding to the surface to be plated Wf-a of the substrate Wf. Each through-hole 450*a* communicates an upper region and a lower region of the ionically resistive element 450. The ionically resistive element 450 is a member for homogenizing a plating film-thickness of the surface to be plated Wf-a of the substrate Wf. That is, since the power feeding contact point is disposed in the outer edge portion of the substrate Wf, as a result of an electric field concentrating in the outer edge portion of the substrate Wf due to a resistance between the outer edge portion and the center part of the substrate Wf, the plating film-thickness in the outer edge portion of the substrate Wf increases in some cases. Regarding this, by disposing the ionically resistive element 450 between the anode 430 and the substrate Wf, the concentration of the electric field in the outer edge portion of the substrate Wf can be reduced, and the homogenization of the plating film-thickness of the surface to be plated Wf-a of the substrate Wf can be facilitated.

The substrate holder 440 includes a supporting member 442 for supporting the outer edge portion of the surface to be plated Wf-a of the substrate Wf. The supporting member 442 includes a seal ring holder 449 having a support surface 449*a* opposed to the outer edge portion of the surface to be plated Wf-a of the substrate Wf, a ring-shaped sealing member 445 arranged in the support surface 449*a*, and a frame 446 for holding the seal ring holder 449 to the substrate holder main body (not illustrated).

The substrate holder 440 also includes a holding member 441 for holding a back surface of the surface to be plated Wf-a of the substrate Wf. The holding member 441 includes a back plate 444 configured to suction-hold the back surface of the surface to be plated Wf-a of the substrate Wf, and a shaft 448 attached to the back surface of a substrate holding surface of the back plate 444. The back plate 444 is connected to a vacuum source (not illustrated), and is configured to vacuum suction-hold the back surface of the substrate Wf by vacuum suctioning from the vacuum source.

The plating module 400 includes an elevating mechanism 443 for raising and lowering the substrate holder 440, and a rotation mechanism 447 for rotating the substrate holder 440 such that the substrate Wf rotates around a virtual axis of the shaft 448 (a virtual rotation axis extending perpendicularly through a center of the surface to be plated Wf-a). The elevating mechanism 443 and the rotation mechanism 447 can be achieved by a known mechanism, such as a motor. The plating module 400 is configured to immerse the substrate Wf into the plating solution of the cathode region 422 using the elevating mechanism 443, and apply voltage between the anode 430 and the substrate Wf to perform a plating process on the surface to be plated Wf-a of the substrate Wf.

The cathode region 422 and the anode region 424 are each filled with the plating solution. Specifically, the plating module 400 includes a plating solution supplying member 425 configured to supply the plating solution toward the center part in the lower region of the ionically resistive element 450. The plating solution supplying member 425 includes a plurality of nozzles 426 opened toward the center part in the lower region of the ionically resistive element 450 in the cathode region 422, and a supply source 428 for supplying the plating solution to the cathode region 422 via the plurality of nozzles 426. The plurality of nozzles 426 are arranged along a circumferential direction on a side wall of the plating tank 410 below the ionically resistive element 450. In the plating module 400, the anode region 424 also includes a mechanism (not illustrated) for supplying the plating solution to the anode region 424.

The plurality of nozzles 426 are configured to supply the plating solution obliquely upward toward the center part in the lower region of the ionically resistive element 450. By further supplying the plating solution from the plurality of nozzles 426 after filling the inside of the plating tank 410 with the plating solution, the plating solution supplied from the plurality of nozzles 426 collides in the center part in the lower region of the ionically resistive element 450 and forms a turbulent flow. In addition, a rectified upflow of the plating solution is formed by the plating solution flowing upward through the plurality of through-holes 450*a* of the ionically resistive element 450. As a result, as illustrated in FIG. 3 and FIG. 4, a center part of the liquid surface of the plating solution is raised.

The elevating mechanism 443 is configured to individually raise and lower the seal ring holder 449 and the back plate 444. Specifically, the elevating mechanism 443 includes a first elevating member 443-1 for raising and lowering the seal ring holder 449, and a second elevating member 443-2 for raising and lowering the back plate 444.

Figure 5:
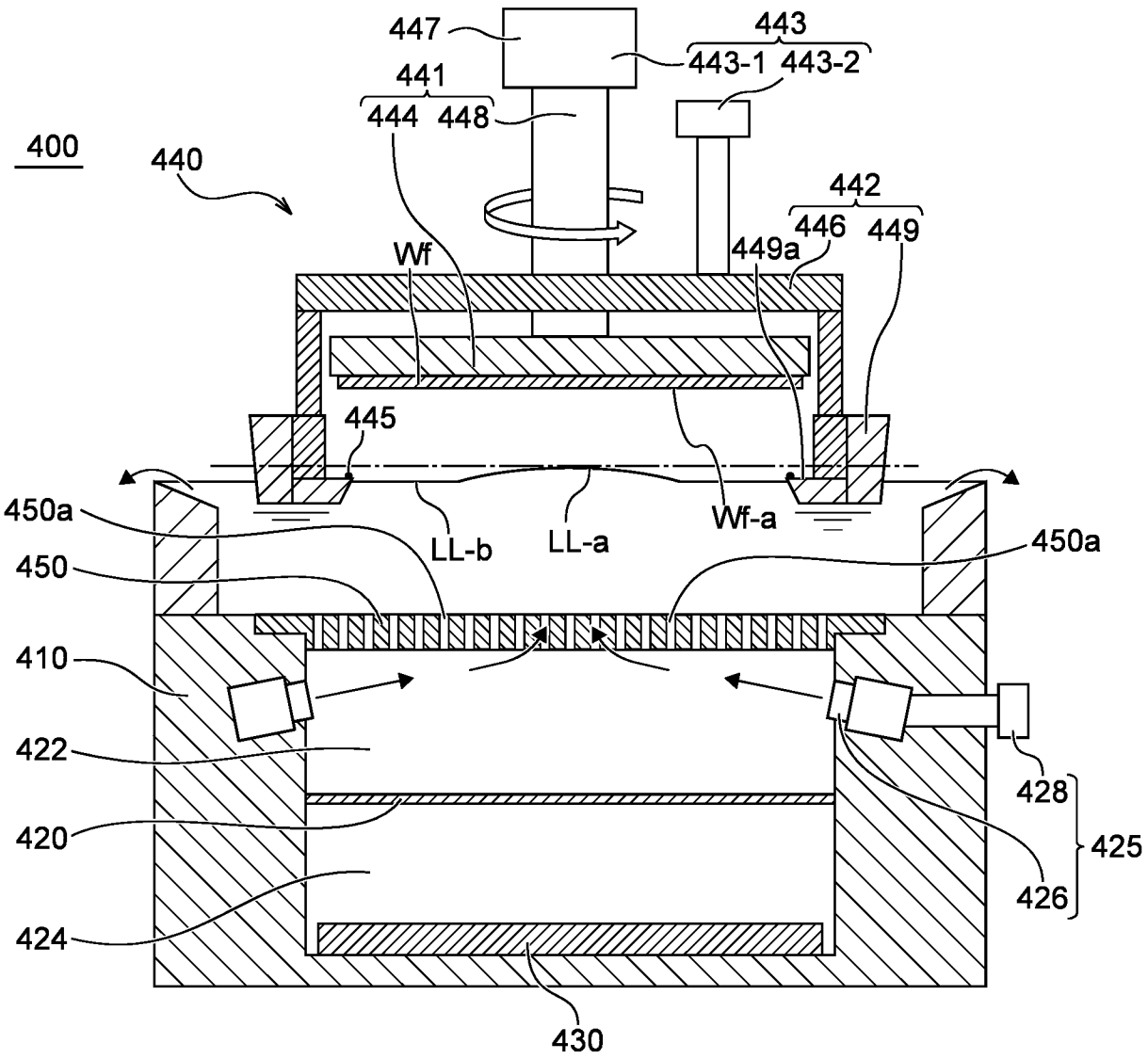
FIG. 5 is a vertical cross-sectional view schematically illustrating the configuration of the plating module of this embodiment in a state where a seal ring holder is lowered.

FIG. 5 is a vertical cross-sectional view schematically illustrating a configuration of the plating module of this embodiment in a state where the seal ring holder is lowered. As illustrated in FIG. 5, the first elevating member 443-1 is configured to lower the seal ring holder 449 to a liquid contact position for which the surface to be plated Wf-a of the substrate Wf is brought into contact with the liquid surface of the plating solution. Here, the liquid contact position means a position at which the sealing member 445 is lower than a raised portion LL-a (the highest part of the raised portion LL-a) of the liquid surface of the plating solution and higher than an unraised portion LL-b of the liquid surface of the plating solution.

Figure 6:
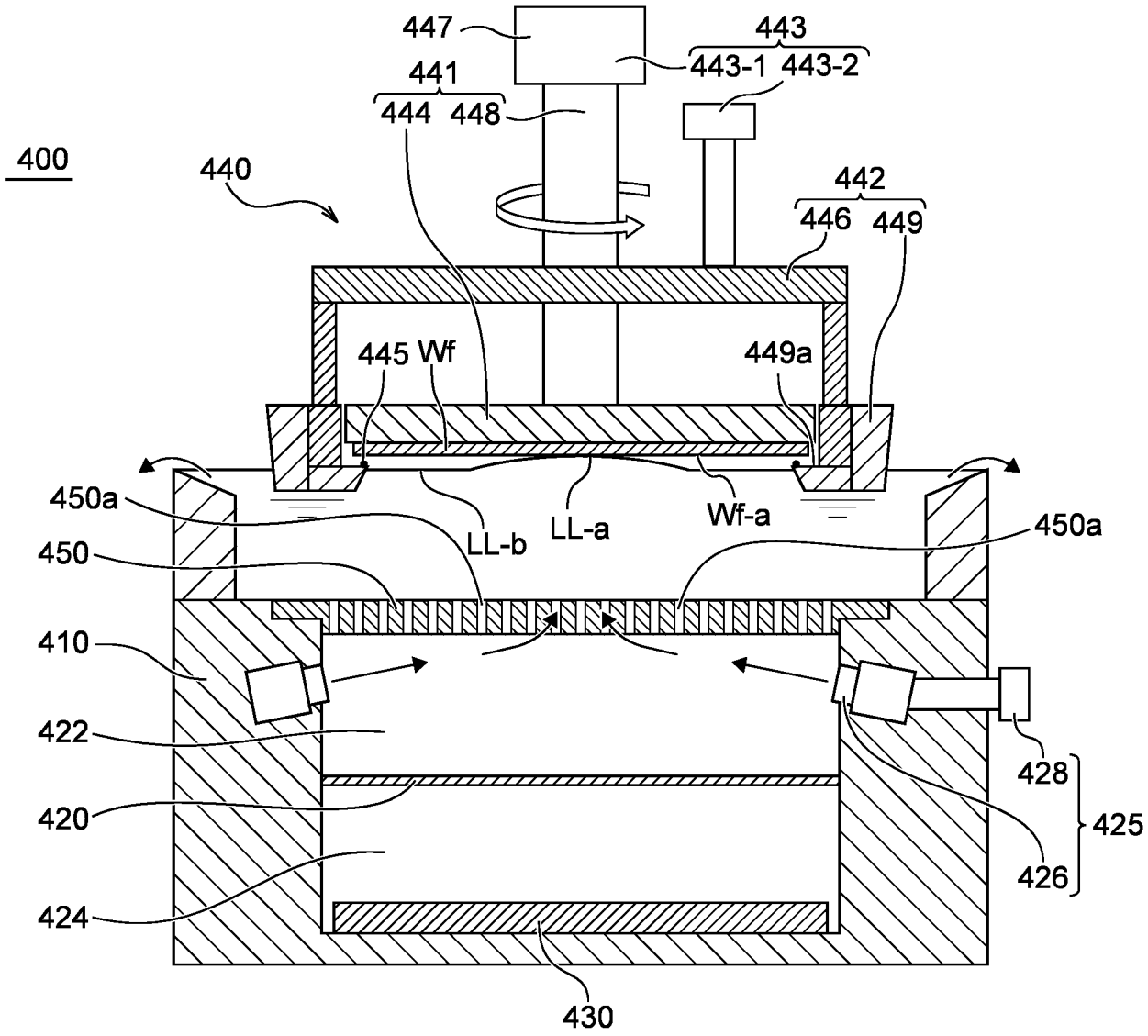
FIG. 6 is a vertical cross-sectional view schematically illustrating the configuration of the plating module of this embodiment in a state where a back plate is lowered, and the substrate is brought into contact with a liquid.
Figure 7:
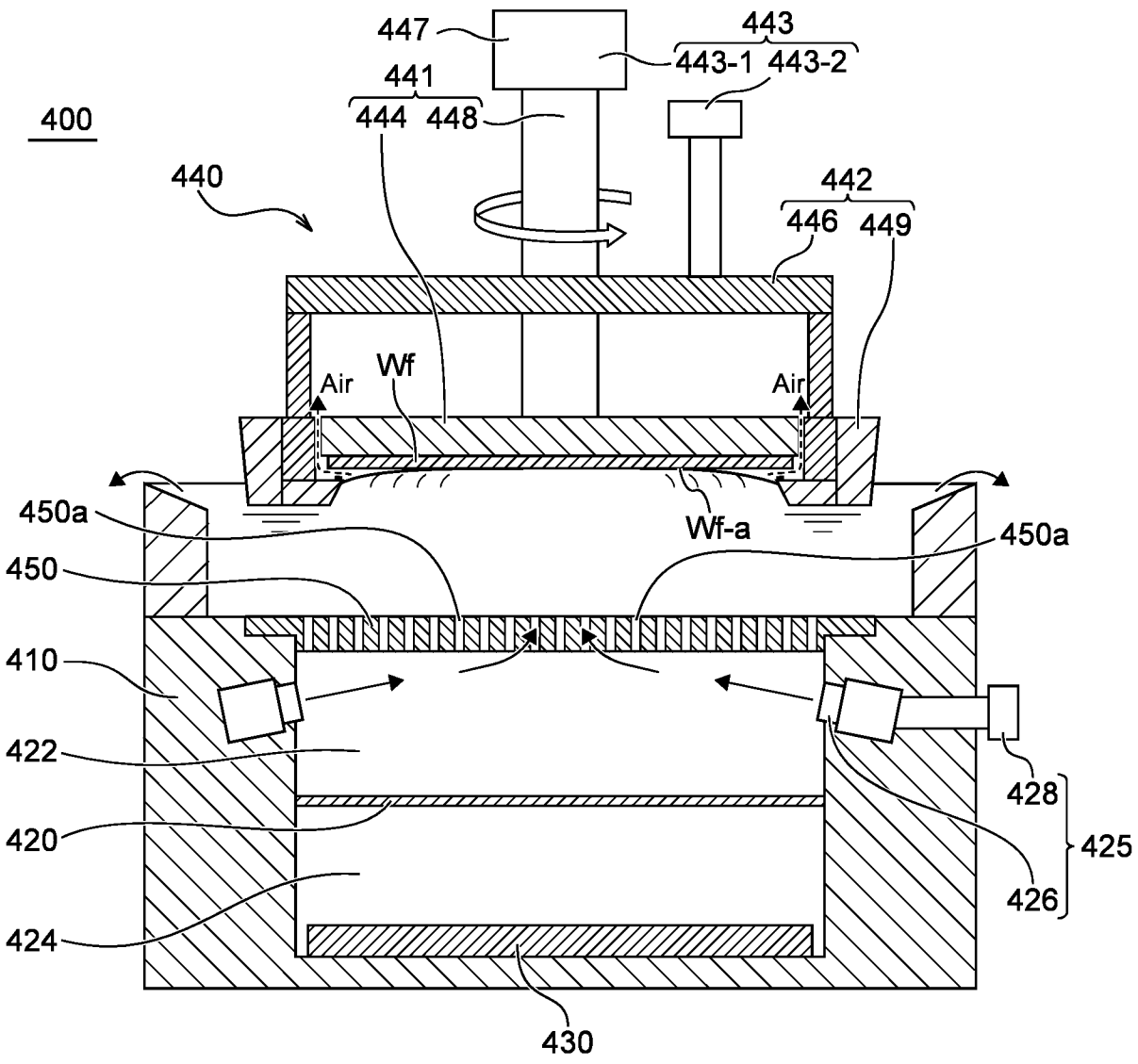
FIG. 7 is a vertical cross-sectional view schematically illustrating the configuration of the plating module of this embodiment in a state where the back plate is lowered, and air is being released.
Figure 8:
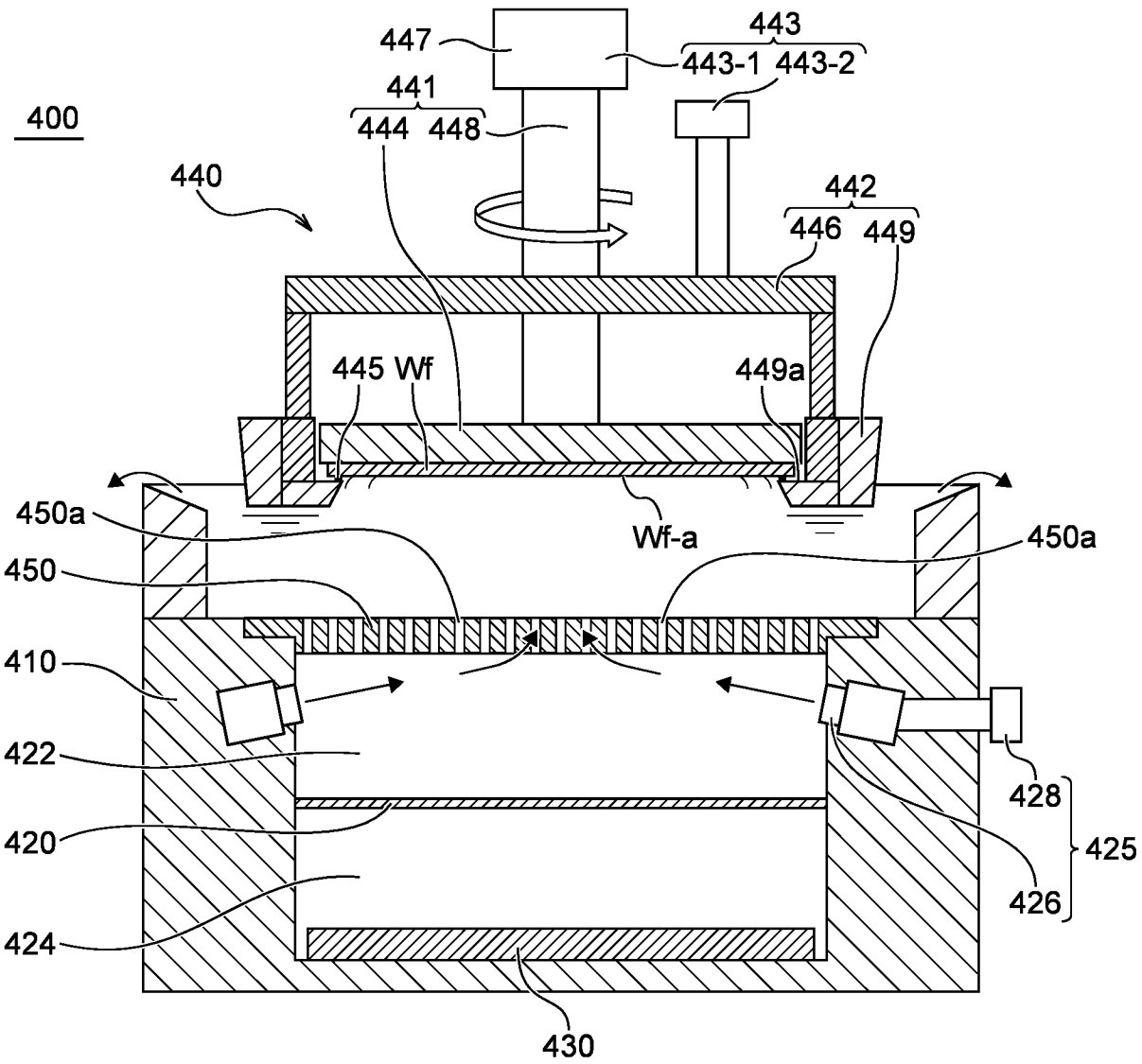
FIG. 8 is a vertical cross-sectional view schematically illustrating the configuration of the plating module of this embodiment in a state where the back plate is lowered, and the substrate is sealed.

FIG. 6 is a vertical cross-sectional view schematically illustrating a configuration of a plating module of this embodiment in a state where the back plate is lowered to bring the substrate into contact with the plating solution. FIG. 7 is a vertical cross-sectional view schematically illustrating a configuration of a plating module of this embodiment in a state where the back plate is lowered, and air is being released. FIG. 8 is a vertical cross-sectional view schematically illustrating a configuration of a plating module of this embodiment in a state where the back plate is lowered, and the substrate is sealed.

The second elevating member 443-2 lowers the back plate 444 such that the substrate Wf is sandwiched by the back plate 444 and the seal ring holder 449. Specifically, as illustrated in FIG. 6, first, the second elevating member 443-2 lowers the back plate 444 until the center part of the surface to be plated Wf-a of the substrate Wf comes into contact with the raised portion LL-a of the liquid surface of the plating solution. Subsequently, as illustrated in FIG. 7, the second elevating member 443-2 gradually lowers the back plate 444 such that the raised portion LL-a of the liquid surface of the plating solution expands in an outer peripheral direction of the surface to be plated Wf-a of the substrate Wf.

Accordingly, the air between the liquid surface of the plating solution and the surface to be plated Wf-a of the substrate Wf is pushed to the outer peripheral side of the surface to be plated Wf-a and exits through between the surface to be plated Wf-a and the sealing member 445. Subsequently, as illustrated in FIG. 8, the second elevating member 443-2 seals the surface to be plated Wf-a by lowering the back plate 444 until the outer edge portion of the surface to be plated Wf-a of the substrate Wf and the sealing member 445 come into contact. The first elevating member 443-1 and the second elevating member 443-2 are configured to lower the substrate Wf to a predetermined position for performing the plating process after the surface to be plated Wf-a of the substrate Wf is sealed.

As described above, the plating module 400 of this embodiment supplies the plating solution from the plurality of nozzles 426 toward the lower region of the ionically resistive element 450 to form a rectified upflow toward the upper region of the ionically resistive element 450 via the plurality of through-holes 450*a* of the ionically resistive element 450, and thus allows raising the center part of the liquid surface of the plating solution efficiently. Furthermore, in addition to causing the center part of the liquid surface of the plating solution to rise, the plating module 400 of this embodiment also lowers the substrate Wf while expanding the plating solution of the raised portion LL-a in the outer peripheral direction of the surface to be plated Wf-a, thus allowing air that may be attached to the surface to be plated Wf-a to be eliminated from the surface to be plated Wf-a. As a result, the plating module 400 according to this embodiment can reduce the amount of air bubbles attached to the surface to be plated Wf-a of the substrate Wf with a simple configuration without using any complicated mechanism such as an inclination mechanism for the substrate Wf to be inclined and immersed into the plating solution.

Figure 9:
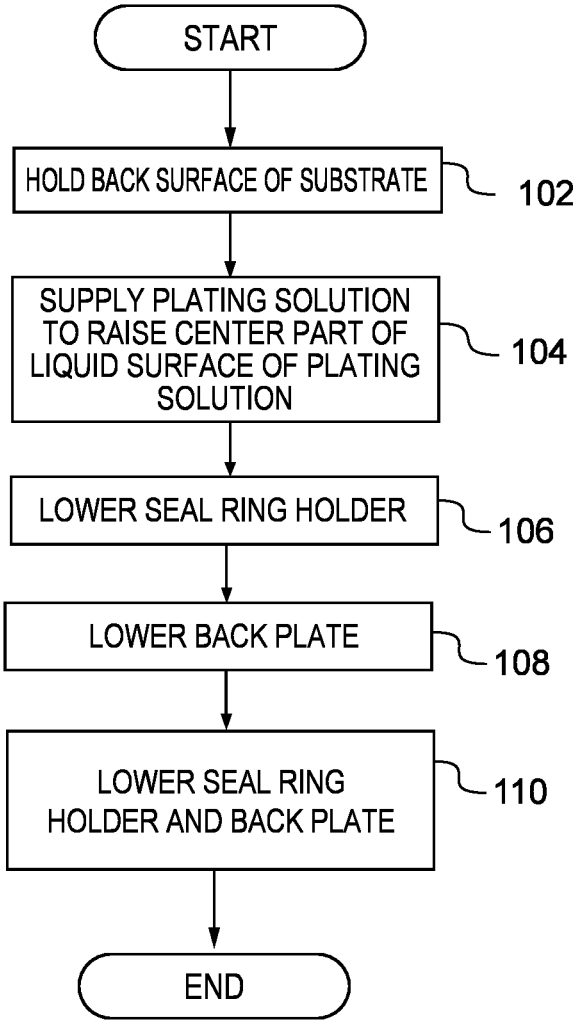
FIG. 9 is a flowchart of a liquid contact method of substrate of this embodiment.

Next, a liquid contact method of substrate using the plating module 400 of this embodiment is described. FIG. 9 is a flowchart of the liquid contact method of substrate of this embodiment.

First, as illustrated in FIG. 4, in the liquid contact method of substrate of this embodiment, the back surface of the substrate Wf is held such that the surface to be plated Wf-a of the substrate Wf is opposed to the liquid surface of the plating solution (holding step 102). The holding step 102 holds the back surface of the substrate Wf by vacuum suction using the back plate 444.

Subsequently, as illustrated in FIG. 4, in the liquid contact method of substrate, the plating solution is supplied to the inside of the plating tank 410 such that the plating solution flows upward through the plurality of through-holes 450*a* in the center part of the ionically resistive element 450, thus raising the center part of the liquid surface of the plating solution (supplying step 104). The supplying step 104 includes a step of supplying the plating solution from the plurality of nozzles 426 arranged along the circumferential direction on the side wall of the plating tank 410 toward the center part in the lower region of the ionically resistive element 450. Accordingly, a turbulent flow is formed by the plating solution supplied from the plurality of nozzles 426 colliding at the center part in the lower region of the ionically resistive element 450, while a rectified upflow is also formed by the plating solution flowing upward through the plurality of through-holes 450*a* of the ionically resistive element 450. As a result, as illustrated in FIG. 4, a center part of the liquid surface of the plating solution rises. An executing order of the holding step 102 and the supplying step 104 may be exchanged, or the steps may be executed simultaneously.

Subsequently, as illustrated in FIG. 5, in the liquid contact method of substrate, the seal ring holder 449 is lowered toward the liquid surface of the plating solution (first lowering step 106). The first lowering step 106 includes a step of lowering the seal ring holder 449 to a liquid contact position. The liquid contact position is lower than the raised portion LL-a of the liquid surface of the plating solution and higher than the unraised portion LL-b of the liquid surface of the plating solution. In other words, the first lowering step 106 includes a step of lowering the seal ring holder 449 such that the sealing member 445 is positioned between the raised portion LL-a and the unraised portion LL-b of the liquid surface of the plating solution. This is because, if the sealing member 445 is higher than the raised portion LL-a of the liquid surface of the plating solution, air that could possibly be attached to the surface to be plated Wf-a of the substrate Wf cannot be released, and if the sealing member 445 is lower than the unraised portion LL-b of the liquid surface of the plating solution, the plating solution invades the support surface 449*a* of the seal ring holder 449. The first lowering step 106 may be executed before the holding step 102 and the supplying step 104, or be executed simultaneously with the holding step 102 and the supplying step 104.

Subsequently, in the liquid contact method of substrate, the back plate 444 is lowered such that the substrate Wf is sandwiched by the back plate 444 and the seal ring holder 449 while the center part of the liquid surface of the plating solution is raised in the supplying step 104 (second lowering step 108). As illustrated in FIG. 6, the second lowering step 108 includes a step of lowering the back plate 444 such that the center part of the surface to be plated Wf-a of the substrate Wf comes into contact with the raised portion LL-a of the liquid surface of the plating solution in the supplying step 104. Furthermore, as illustrated in FIG. 7 and FIG. 8, the second lowering step 108 includes a step of lowering the back plate 444 until the outer edge portion of the surface to be plated Wf-a of the substrate Wf and the sealing member 445 come into contact.

Subsequently, in the liquid contact method of substrate, the back plate 444 and the seal ring holder 449 are lowered together such that the substrate Wf is arranged in a predetermined position for which the plating process is performed (third lowering step 110). Once the substrate Wf is arranged in the predetermined position, the plating module 400 performs the plating process on the substrate Wf.

In the liquid contact method of substrate of this embodiment, in addition to the center part of the liquid surface of the plating solution being raised, the substrate Wf is lowered while the plating solution of the raised portion LL-a expands in an outer peripheral direction of the surface to be plated Wf-a, and thus air possibly attached to the surface to be plated Wf-a can be eliminated from the surface to be plated Wf-a. As a result, in the liquid contact method of substrate of this embodiment, the amount of air bubbles attached to the surface to be plated Wf-a of the substrate Wf can be reduced with a simple configuration without using any complicated mechanism, such as an inclination mechanism for the substrate Wf to be inclined and immersed into the plating solution.

Several embodiments of the present invention have been described above in order to facilitate understanding of the present invention without limiting the present invention. The present invention can be changed or improved without departing from the gist thereof, and of course, the equivalents of the present invention are included in the present invention. It is possible to arbitrarily combine or omit respective constituent elements described in the claims and specification in a range in which at least a part of the above-described problems can be solved, or a range in which at least a part of the effects can be exhibited.

This application discloses, as one embodiment, a liquid contact method of substrate including: a holding step of holding a back surface of a substrate with a holding member such that a surface to be plated of the substrate is opposed to a liquid surface of a plating solution housed in a plating tank; a supplying step of supplying the plating solution to the plating tank such that the plating solution upwardly flows through a plurality of through-holes in a center part of an ionically resistive element arranged inside the plating tank to raise a center part of the liquid surface of the plating solution; a first lowering step of lowering a supporting member for supporting an outer edge portion of the surface to be plated of the substrate held by the holding member toward the liquid surface of the plating solution; and a second lowering step of lowering the holding member such that the substrate is sandwiched by the supporting member lowered in the first lowering step and the holding member while the center part of the liquid surface of the plating solution is raised in the supplying step.

This application further discloses, as one embodiment, the liquid contact method of substrate in which the first lowering step includes a step of lowering the supporting member such that a sealing member of the supporting member configured to seal the outer edge portion of the surface to be plated of the substrate is positioned to a liquid contact position. The liquid contact position is lower than a raised portion of the liquid surface of the plating solution and higher than an unraised portion of the liquid surface of the plating solution.

This application further discloses, as one embodiment, the liquid contact method of substrate in which the second lowering step includes: a step of lowering the holding member such that the center part of the surface to be plated of the substrate comes into contact with the raised portion of the liquid surface of the plating solution in the supplying step; and a step of lowering the holding member until the outer edge portion of the surface to be plated of the substrate and the sealing member come into contact.

This application further discloses, as one embodiment, the liquid contact method of substrate in which the supplying step includes a step of supplying the plating solution from a plurality of nozzles arranged along a circumferential direction on a side wall of the plating tank toward the center part in the lower region of the ionically resistive element.

This application further discloses, as one embodiment, the liquid contact method of substrate in which the holding step includes a step of suction-holding the back surface of the surface to be plated of the substrate using the holding member.

This application further discloses, as one embodiment, a plating apparatus including: a plating tank for housing a plating solution; a holding member for holding a back surface of a substrate such that a surface to be plated of the substrate is opposed to a liquid surface of the plating solution housed in the plating tank; a supporting member for supporting an outer edge portion of the surface to be plated of the substrate held by the holding member; an elevating mechanism for individually raising and lowering the holding member and the supporting member; an ionically resistive element arranged inside the plating tank so as to be opposed to the surface to be plated of the substrate, a plurality of through-holes communicating a lower region and an upper region of the ionically resistive element being formed inside the ionically resistive element; and a plating solution supplying member configured to supply the plating solution toward a center part in the lower region of the ionically resistive element.

This application further discloses, as one embodiment, the plating apparatus in which the elevating mechanism includes a first elevating member lowering the supporting member to a liquid contact position for which the surface to be plated of the substrate is brought into contact with the liquid surface of the plating solution, and a second elevating member lowering the holding member such that the substrate is sandwiched by the supporting member lowered to the liquid contact position by the first elevating member and the holding member.

This application further discloses, as one embodiment, the plating apparatus in which the supporting member includes a seal ring holder having a support surface opposed to the outer edge portion of the surface to be plated of the substrate and a sealing member arranged on the support surface, the liquid contact position is a position at which the sealing member is lower than a raised portion in a center of the liquid surface of the plating solution and higher than an unraised portion of the liquid surface of the plating solution by supplying the plating solution from the plating solution supplying member, and the second elevating member is configured to lower the holding member until the sealing member and the outer edge portion of the surface to be plated of the substrate come into contact.

This application further discloses, as one embodiment, the plating apparatus in which the plating solution supplying member includes a plurality of nozzles arranged along a circumferential direction on a side wall of the plating tank and a supply source for supplying the plating solution from the plurality of nozzles.

This application further discloses, as one embodiment, the plating apparatus in which the plurality of nozzles are configured to supply the plating solution obliquely upward toward the center part in the lower region of the ionically resistive element to raise the center part of the liquid surface of the plating solution.

This application further discloses, as one embodiment, the plating apparatus in which the holding member includes a back plate configured to suction-hold the back surface of the surface to be plated of the substrate.

This application further discloses, as one embodiment, the plating apparatus in which the ionically resistive element is a plate-shaped member disposed in the plating tank so as to be opposed to the surface to be plated of the substrate, the plurality of through-holes is formed in a region corresponding to the surface to be plated of the substrate inside the ionically resistive element.

REFERENCE SIGNS LIST

102 . . . holding step
104 . . . supplying step
106 . . . first lowering step
108 . . . second lowering step
110 . . . third lowering step
400 . . . plating module
410 . . . plating tank
426 . . . nozzle
428 . . . supply source
430 . . . anode
440 . . . substrate holder
441 . . . holding member
442 . . . supporting member
443 . . . elevating mechanism
443-1 . . . first elevating member
443-2 . . . second elevating member
444 . . . back plate
445 . . . sealing member
449 . . . seal ring holder
449*a* . . . support surface
450 . . . ionically resistive element
450*a* . . . through-hole
1000 . . . plating apparatus
LL-a . . . raised portion
LL-b . . . unraised portion
Wf . . . substrate
Wf-a . . . surface to be plated

The invention claimed is:

1. A liquid contact method of a substrate, comprising:

a holding step of holding a back surface of the substrate with a holding member such that a surface to be plated of the substrate is opposed to a liquid surface of a plating solution housed in a plating tank;

a supplying step of supplying the plating solution to the plating tank such that the plating solution upwardly flows through a plurality of through-holes in a center part of an ionically resistive element arranged inside the plating tank to raise a center part of the liquid surface of the plating solution;

a first lowering step of lowering a supporting member for supporting an outer edge portion of the surface to be plated of the substrate held by the holding member toward the liquid surface of the plating solution, the supporting member comprising a sealing member configured to seal an outer edge portion of the surface to be plated, wherein the first lowering step includes lowering the supporting member such that the sealing member is positioned into a liquid contact position, and the liquid contact position is lower than a raised portion of the liquid surface of the plating solution and higher than an unraised portion of the liquid surface of the plating solution; and a second lowering step of lowering the holding member such that the substrate is sandwiched by the supporting member lowered in the first lowering step and the holding member while the center part of the liquid surface of the plating solution is raised in the supplying step.

2. The liquid contact method of the substrate according to claim 1, wherein the second lowering step includes: a step of lowering the holding member such that the center part of the surface to be plated of the substrate comes into contact with the raised portion of the liquid surface of the plating solution in the supplying step; and a step of lowering the holding member until the outer edge portion of the surface to be plated of the substrate and the sealing member come into contact.

3. The liquid contact method of the substrate according to claim 1, wherein the supplying step includes a step of supplying the plating solution from a plurality of nozzles arranged along a circumferential direction on a side wall of the plating tank toward the center part in the lower region of the ionically resistive element.

4. The liquid contact method of the substrate according to claim 1, wherein the holding step includes a step of suction-holding the back surface of the surface to be plated of the substrate using the holding member.

* * * * *